US005294264A

United States Patent [19]

Tiegs et al.

[11] Patent Number: 5,294,264

[45] Date of Patent: * Mar. 15, 1994

[54] METHOD OF NITRIDING REFRACTORY METAL ARTICLES

[75] Inventors: Terry N. Tiegs, Lenoir City; Cressie E. Holcombe, Knoxville; Norman L. Dykes, Oak Ridge, all of Tenn.; Ogbemi O. Omatete, Lagos, Nigeria; Albert C. Young, Flushing, N.Y.

[73] Assignee: Martin Marietta Energy Systems, Inc., Oak Ridge, Tenn.

[ * ] Notice: The portion of the term of this patent subsequent to Oct. 13, 2009 has been disclaimed.

[21] Appl. No.: 820,452

[22] Filed: Jan. 10, 1992

Related U.S. Application Data

[63] Continuation-in-part of Ser. No. 512,306, Apr. 20, 1990, abandoned.

[51] Int. Cl.[5] ..... C21D 1/09

[52] U.S. Cl. ..... 148/207; 148/220; 148/224; 219/678; 427/553; 427/595

[58] Field of Search ..... 148/207, 218, 220, 224; 427/553, 595; 204/157.43, 157.46; 219/10.55 R

[56] References Cited

U.S. PATENT DOCUMENTS

| | | | |
|---|---|---|---|
| 3,171,009 | 2/1965 | Scheller et al. | 219/10.55 |
| 3,585,258 | 6/1971 | Levinson | 264/26 |
| 4,057,702 | 11/1977 | Lacombe-Allard | 219/10.55 A |
| 4,100,386 | 7/1978 | Bardet | 219/10.55 M |
| 4,147,911 | 4/1979 | Nishitani | 219/10.55 M |
| 4,163,140 | 7/1979 | Bardet | 219/10.55 B |
| 4,189,629 | 2/1980 | Kraze | 219/10.55 A |
| 4,307,277 | 12/1981 | Maeda et al. | 219/10.55 R |
| 4,323,745 | 4/1982 | Berggren et al. | 219/10.55 A |
| 4,529,856 | 7/1985 | Meek et al. | 219/10.55 M |
| 4,529,857 | 7/1985 | Meek et al. | 219/10.55 M |
| 4,559,429 | 12/1985 | Holcombe | 219/10.55 F |
| 4,565,669 | 1/1986 | Collins et al. | 219/10.55 F |
| 4,683,363 | 7/1987 | Scovell | 219/10.55 A |
| 4,743,340 | 5/1988 | Wrenn, Jr. et al. | 162/152 |
| 4,757,172 | 7/1988 | Palaith et al. | 219/10.55 M |
| 4,764,102 | 8/1988 | Takahashi | 219/10.55 R |
| 4,767,902 | 8/1988 | Palaith et al. | 219/10.55 M |
| 4,771,153 | 9/1988 | Fukushima et al. | 219/10.55 B |
| 4,772,770 | 9/1988 | Matsui et al. | 219/10.55 A |
| 4,784,686 | 11/1988 | Meek et al. | 75/345 |
| 4,806,718 | 2/1989 | Seaborne et al. | 219/10.55 E |
| 4,808,780 | 2/1989 | Seaborne | 219/10.55 E |
| 4,810,846 | 3/1989 | Holcombe et al. | 219/10.55 R |
| 4,880,578 | 11/1989 | Holcombe et al. | 264/26 |
| 4,894,194 | 1/1990 | Janney | 264/109 |
| 5,028,362 | 7/1991 | Janney et al. | 264/25 |
| 5,154,779 | 10/1992 | Holcombe et al. | 148/207 |

FOREIGN PATENT DOCUMENTS

| | | | |
|---|---|---|---|
| 1-252786 | 10/1989 | Japan | 427/595 |

OTHER PUBLICATIONS

C. E. Holcombe and N. L. Dykes, "High-Temperature Microwave Sintering of Nonoxide Ceramics," 91*st Annual Meeting of the American Ceramics Society*, Apr. 25, 1989.

(List continued on next page.)

*Primary Examiner*—George Wyszomierski
*Attorney, Agent, or Firm*—Ivan L. Ericson; J. Donald Griffin; Harold W. Adams

[57] ABSTRACT

A method of nitriding a refractory-nitride forming metal or metalloid articles and composite articles. A consolidated metal or metalloid article or composite is placed inside a microwave oven and nitrogen containing gas is introduced into the microwave oven. The metal or metalloid article or composite is heated to a temperature sufficient to react the metal or metalloid with the nitrogen by applying a microwave energy within the microwave oven. The metal or metalloid article or composite is maintained at that temperature for a period of time sufficient to convert the article of metal or metalloid or composite to an article or composite of refractory nitride. In addition, a method of applying a coating, such as a coating of an oxide, a carbide, or a carbo-nitride, to an article of metal or metalloid by microwave heating.

14 Claims, No Drawings

OTHER PUBLICATIONS

C. E. Holcombe, T. T. Meek, and N. L. Dykes "Unusual Properties of Microwave-Sintered Yttria-2 wt.% Firconia," *J. Mat'l Sc. Letters*, 7, 881-884 (1988).

C. E. Holcombe, T. T. Meek, and N. L. Dykes "Enhanced Thermal Shock Properties of $Y_2O_3$-2wt.%-$ZrO_2$ Heated Using 2.45 GHz Radiation," *Mat. Res. Soc. Symp. Proc.*, vol. 124, Apr. 5-8 (1988).

W. H. Sutton, "Microwave Processing of Ceramic Materials," *Ceramic Bulletin*, vol. 68, No. 2, 376-286 (1989).

C. E. Holcombe, "New Microwave Coupler Material", *Am. Ceram. Soc. Bulletin*, vol. 62, 1388 (1983).

J. A. Mangels, "Effect of Rate-Controlled Nitriding and Nitrogen Atmospheres on the Formation of Reaction-Bonded $Si_3N_4$," *Am. Ceram. Soc. Bull.*, 60, 613-617 (1981) discusses rate-controlled nitriding.

J. M. Blocher, Jr. "Nitrides", *High-Temperature Materials and Technology*, Chap 11, 379-382 (1967) discusses nitrides of fransition elements of the third, fourth, fifth, and sixth groups of the periodic table.

*The Condensed Chemical Dictionary*, Van Nostrand Reinhold Company, Tenth Edition, 741, 887 (1981) discusses definitions of "nonmental" and refractory.

R. I. Jaffee, D. J. Maykuth, and E. M. Sherwood, "Refractory Metals and Metalloids", *High-Temperature Materials and Technology*, Ch. 6, 152-154 (1967) discusses refractory metals and metalloids.

R. W. Davidge, "Fiber-Reinforced Ceramics," in *Composites*, vol. 18, No. 2, pp. 92-100, 1987.

T. N. Tiegs, J. O. Kiggans and H. D. Kimrey, "Microwave Processing of $Si_3N_4$," Proceedings of Mater, Res. Soc. Spring Meeting, San Francisco, Calif., 1991.

O. O. Omatete, R. A. Strehlow, and C. A. Walls, "Gelcasting of Submicron Alumina, Sialon and Silicon Nitride Powders," Proceedings of the 37th Sagamore Army Materials Research Conference, Plymouth, Mass., 1990.

D. W. Richerson, *Modern Ceramic Engineering*, Marcel Dekker Inc., New York, p. 250, 1982.

J. W. Lucek, et al., "Stability of Continuous Si-C(-O) Reinforcing Elements in RBSN process Environments," NASA Conf. Pub. #2406, pp. 27-38, 1985.

D. B. Fischbach and P. M. Lemoine, "Influence of a CVD Carbon Coating on the Mechanical Property Stability of Nicalon SiC Fiber," Composites Sci. & Tech., 37, pp. 55-61, 1990.

T. J. Clark, et al., "Thermal Degradation of Nicalon Sic Fibers," Ceram. Eng. Sci. Proc., 6, [7-8], pp. 576-588, 1985.

F. L. Riley, "Silicon Nitridation," pp. 121-133 in *Progress in Nitrogen Ceramics*, F. L. Riley, ed., NATO ASI Applied Science Series E No. 65, Nijhoff, The Hague, 1983.

H. E. Kim and A. J. Moorhead, "Strength of Nicalon Silicon Fibers Exposed to High-Temperature Gaseous Environments," J. Am Ceram. Soc., 74, pp. 666-669, 1991.

B. W. Sheldon and J. S. Haggerty, "Nitridation of High-Purity, Laser-Synthesized Silicon Powder to Form Reaction-Bonded Silicon Nitride,"*Ceram. Eng. Sci. Pro.*, 9, [7-8], 1061-1072, 1988.

N. D. Corbin, et al., "The Influence of Interfacial Modifiers on RBSN Matrix Composites Properties," Proceedings of DOD-NASA Conference on Ceramic Matrix Composites, Cocoa Beach, Fla., Jan. 1986.

N. D. Corbin, et al, "RBSN Matrix Composites Reinforced with Polymer Derived Fibers," Proceedings of DOD-NASA Conference on Ceramic Matrix Composites, Cocoa Beach, Fla., Jan. 1987.

T. L. Starr, et al., "Development of Continuous Fiber--Reinforced Silicon Nitride," ORNL/FMP-901, Conf. 900546, 1990.

A. C. Young, O. O. Omatete, M. A. Janney, and P. A. Menchhofer, "Gelcasting of Alumina," J. Am. Ceram. Soc., 74, pp. 612-618, 1991.

O. O. Omatete, A. C. Young, M. A. Janney, and J. H. Adair, "Investigation of Dilute Gelcasting Alumina Suspension," Ceramic Powder Science III, Ceram. Trans, vol. 12, G. L. Messing, S. H. Hirano, and H. Hausner, eds., The American Ceramic Society, Inc., pp. 537-544, 1990.

METHOD OF NITRIDING REFRACTORY METAL ARTICLES

This invention was made with Government support under Contract No. DE-AC05-84OR21400 awarded by the U.S. Department of Energy to Martin Marietta Energy Systems, Inc. and the Government has certain rights in this invention.

This is a continuation-in-part of copending U.S. patent application Ser. No. 07/512,306, filed Apr. 20, 1990, entitled A METHOD OF NITRIDING REFRACTORY METAL ARTICLES, now abandoned.

FIELD OF THE INVENTION

This invention relates to a method of nitriding. More particularly, this invention relates to a method of nitriding metal and metalloid articles and composite articles.

BACKGROUND OF THE INVENTION

The nitrides of many metals and metalloids have high melting points and are resistant to oxidation. Currently, powders of these nitrides are consolidated into a body, then the body is hot-pressed or hot-isostatic-pressed at high temperatures and pressures into a dense body. Operations of this type require expensive equipment and usually long periods of time. Also, bodies are frequently in a highly-stressed state after this type of heating and pressing operation.

The object of the subject invention is to provide a method for nitriding refractory metal and metalloid articles to form dense, crack-free bodies of metal or metalloid nitrides, composites of these nitrides, coatings of these nitrides, and nitrides of metal and metalloid articles having a density less then theoretical density.

SUMMARY OF THE INVENTION

In accordance with one aspect of the present invention, a new and improved method of nitriding a refractory-nitride forming metal or metalloid article comprises the following steps:

Step 1. A consolidated metal or metalloid article having an intimately contacting enwrapment of a ceramic aggregate of granular material of average particle size ranging from −4 to +100 mesh is provided within a microwave oven.

Step 2. A nitrogen containing atmosphere is introduced into the microwave oven.

Step 3. The metal or metalloid article is heated by microwave energy within the microwave oven containing the nitrogen containing atmosphere to a temperature sufficient to react the metal or metalloid with the nitrogen by applying a microwave energy within the microwave oven.

Step 4. The metal or metalloid article is maintained at the temperature for a period sufficient to convert the metal or metalloid to a metal nitride or a metalloid nitride.

In accordance with another aspect of the present invention, a new and improved method of providing a nitride coating on a metal or metalloid article comprises the following steps:

Step 1. A consolidated metal or metalloid article having an intimately contacting enwrapment of a ceramic aggregate of granular material of average particle size ranging from −4 to +100 mesh is provided within a microwave oven.

Step 2. A nitrogen containing atmosphere is introduced into the microwave oven.

Step 3. The metal or metalloid article is heated by microwave energy within the microwave oven containing the nitrogen containing atmosphere to a temperature sufficient to react the metal or metalloid with the nitrogen by applying a microwave energy within the microwave oven.

Step 4. The metal or metalloid article is maintained at the temperature for a period sufficient to form a coating of metal nitride or metalloid nitride on the article of metal or metalloid.

In accordance with another aspect of the present invention, a new and improved method of providing an oxide coating on a refractory-oxide-forming metal or metalloid article comprises the following steps:

Step 1. A consolidated refractory-oxide-forming metal or metalloid article having an intimately contacting enwrapment of a ceramic aggregate of granular material of average particle size ranging from −4 to +100 mesh is provided within a microwave oven.

Step 2. An atmosphere containing oxygen is introduced into the microwave oven.

Step 3. The refractory-oxide-forming metal or metalloid article is heated by microwave energy within the microwave oven containing the atmosphere to a temperature sufficient to react the refractory-oxide-forming metal or metalloid with the oxygen contained in the atmosphere by applying a microwave energy within the microwave oven.

Step 4. The refractory-oxide-forming metal or metalloid article is maintained at the temperature for a period sufficient to form a coating of oxide on the article of the refractory-oxide-forming metal or metalloid.

In accordance with another aspect of the present invention, a new and improved method of providing a carbide coating on a refractory-carbide-forming metal or metalloid article comprises the following steps:

Step 1. A consolidated refractory-carbide-forming metal or metalloid article having an intimately contacting enwrapment of a ceramic aggregate of granular material of average particle size ranging from −4 to +100 mesh is provided within a microwave oven.

Step 2. A carbon containing atmosphere is introduced into the microwave oven.

Step 3. The refractory-carbide-forming metal or metalloid article is heated by microwave energy within the microwave oven containing the carbon containing atmosphere to a temperature sufficient to react the refractory-carbide-forming metal or metalloid with the methane contained in the atmosphere by applying a microwave energy within the microwave oven.

Step 4. The refractory-carbide-forming metal or metalloid article is maintained at the temperature for a period sufficient to form a carbide coating on the article of the refractory-carbide-forming metal or metalloid.

In accordance with another aspect of the present invention, a new and improved method of providing a metal carbo-nitride coating on a refractory-"carbo"-nitride-forming metal or metalloid article comprises the following steps:

Step 1. A consolidated refractory-"carbo"-nitride-forming metal or metalloid article having an intimately contacting enwrapment of a ceramic aggregate of granular material of average particle size ranging from −4 to +100 mesh is provided within a microwave oven.

Step 2. A carbon and nitrogen containing atmosphere is introduced into the microwave oven.

Step 3. The refractory-"carbo"-nitride-forming metal or metalloid article is heated by microwave energy within the microwave oven containing the carbon and nitrogen containing atmosphere to a temperature sufficient to react the refractory-"carbo"-nitride-forming metal or metalloid with the methane and nitrogen contained in the atmosphere by applying a microwave energy within the microwave oven.

Step 4. The refractory-"carbo"-nitride-forming metal or metalloid article is maintained at the temperature for a period sufficient to form a carbo-nitride coating on the article of refractory-"carbo"-nitride-forming metal or metalloid.

DETAILED DESCRIPTION OF THE PREFERRED EMBODIMENTS

The new and improved method of the present invention for fabricating of refractory-nitride forming metal or metalloid dense articles, composites and coatings comprises the following operations (where refractory-nitride-forming "metal" refers to Ti, Zr, Hf, Nb, Ta, and Al; and where "metalloid" refers to refractory-nitride-forming nonmetals such as Si and B):

1) consolidating (i.e., pressed powder) at least one material selected from the group consisting of refractory metals, refractory metal nitrides, aluminum, silicon, and boron into a selected configuration;
2) surrounding the configuration with an intimately contacting enwrapment of a ceramic aggregate of granular material having an average particle size ranging from −4 to 100 mesh and selected from the group consisting of alumina, calcia, magnesia, yttria, and silicon nitride in which the granular materials are electrical and thermal insulators and essentially noncouplers with microwaves to prevent electrical sparking and to provide thermal insulation for the configuration; and
3) heating the enwrapped configuration with microwaves in a nitrogen atmosphere or a nitrogen containing atmosphere such as $NH_3$ or mixtures of $N_2$—$H_2$, $NH_3$—$H_2$, $N_2$—Ar to a desired temperature for conversion of any non-nitride portion in the enwrapped material to a nitride and densification of the formed nitrides.

EXAMPLE I

In a demonstration of the subject invention, a powder mixture containing 50 wt. % niobium, 20 wt. % tungsten and 30 wt. % titanium nitride was pressed into a disc having a diameter and a thickness of 1 inch. The disc was surrounded with grit of yttria having a particle size ranging from 150 to 425 microns in a encasement of alumina brick that had been arranged in a microwave oven. The oven was equipped with a standard-energy (1.6kW) and standard-frequency (2.45 GHz) microwave unit.

In the heating operation, the disc was exposed to the maximum energy level of 1.6 kW for 100 minutes in an environment of flowingnitrogen. Then, the power switch on the oven was moved to the "off" position and the disc was cooled to ambient temperature in the flowing nitrogen. The cooled disc was removed from the arrangement in the oven and easily brushed free of the yttria granules.

The disc was visually examined for cracks, then the physical characteristics of the disc were determined.

The tests indicated that the disc was completely sintered and crack free. Standard mercury intrusion porosimetry techniques indicated a real density of 7.68 g/cc, an open porosity of 40% and a closed porosity of 4%.

A commercial tester indicated a microhardness of 190 diamond pyramid hardness/knoop (DPH), using an average of 3 to 5 measurements rounded to the nearest 5 kg/mm$^2$. Analyses indicated that the disc contained 53.5% of niobium nitride, 27.9% of titanium nitride and 18.6% of tungsten.

EXAMPLE II

In another demonstration of the subject invention, a powder mixture containing 50 wt. % niobium, 20 wt. % tungsten and 30 wt. % titanium nitride was pressed into a disc having a diameter and thickness of 1 inch. The disc was surrounded in alumina grit having a particle size ranging from 150 to 425 microns in an encasement of alumina brick, except alumina grit was used instead of yttria granules. This arrangement was assembled in a microwave oven, and the metals contained in the disc were converted to a nitride of the metals and sintered as described in Example I.

The processed disc was visually examined for cracks, then the physical characteristics of the disc were determined. These tests indicated that the disc was completely sintered and crack-free. Standard mercury intrusion porosimetry techniques indicated a real density of 7.7 g/cc, an open porosity of 42% and a closed porosity of 4%. A commercial tester indicated a microhardness of 190 DPH, using an average of 3 to 5 measurements rounded to the nearest 5 kg/mm$^2$. Analyses indicated that the disc contained 53 wt. % of niobium nitride, 28 wt. % titanium nitride and 19 wt. % of tungsten.

EXAMPLE III

A powder mixture having a 99% purity and 325-mesh particles was pressed into a disc. The powder mixture contained 88.1 wt. % elemental silicon, 9.5 wt. % yttrium oxide and 2.4 wt. % aluminum oxide. Also, the pressed disc had a diameter of I inch and a thickness of 0.5 inch. In preparation for the heating operation, the disc was surrounded in yttria grit with particle sizes ranging from 150 to 425 microns inside a case of alumina brick. This arrangement was assembled inside a microwave oven. The pressed disc was converted to a nitride composite and sintered by the procedure described in EXAMPLE I.

Visual examination indicated that the processed disc was free of cracks. The processed disc was designed to convert to a composition consisting of 92.5 wt. % silicon nitride, 6.0 wt. % yttrium oxide and 1.5 wt. % aluminum oxide, with a theoretical density of 3.2 g/cc. Dimensional measurements indicated the density of the processed disc was 70% of the theoretical density.

Control of the temperatures (1400° to 1875° C.) and time period of exposure (10 to 100 minutes) is required to obtain full density. However, this experiment indicated that ceramic compositions with a silicon nitride base can be synthesized by the subject development.

EXAMPLE IV

A silicon powder consisting of greater than 99.95% purity was pressed into a cylindrical compact having approximate dimensions of 2 inches diameter and 1.75 inches in length. The sample was placed in a boron nitride crucible containing silicon nitride—2 wt. % yttria powder having an average particle size of approximately 2 μm. An alumina fiber board was placed around the crucible. This arrangement was placed in a microwave oven and the oven filled with nitrogen gas.

The compact temperature was monitored by a thermocouple and heated to 1400° C. oven for about 23 hr. The compact was converted to greater than 78% silicon nitride.

EXAMPLE V

A powder mixture consisting of 86.9 wt. % silicon (>99.95%), 9.8 wt. % yttria and 3.3 wt. % alumina were blended together and pressed into a compact and placed in a crucible as described in Example IV and the arrangement as described in Example IV was placed in the oven. The oven was filled with argon gas. The temperature of the compact was then raised to approximately 1000° C. Nitrogen was then flowed into the microwave furnace and the temperature raised to 1400° C. The total treating time in the microwave oven was about 24 hr. The compact was converted to greater than 75% silicon nitride.

Synthesis of silicon nitride by direct reaction of a silicon bar with nitrogen is known in the art. However, the use of powder and of microwave radiation for heating the compacted powder is believed to be new. It was not known that elemental silicon could be heated to a temperature sufficient for conversion to silicon nitride with microwave radiation.

EXAMPLE VI

A sample of −325 mesh powder of niobium—1 wt. % zirconium (Nb-1Zr) alloy was pressed into a disc having a diameter of 1 inch and a thickness of 0.5 inch. The disc was arranged in a microwave oven as described in EXAMPLE I, then exposed to the maximum energy level (1.6 kW for 90 minutes in flowing argon. The environment of the furnace was changed from flowing argon to flowing nitrogen, then heated for 5 minutes in the nitrogen environment at the maximum energy level. The disc was cooled in the nitrogen environment and removed from the microwave oven.

Visual inspection indicated that the processed disc was free of cracks. Microscopic examination indicated that the surface of the processed disc was heavily nitrided and the interior of the processed disc metallic. A major portion of the surface nitride was identified as zirconium nitride and the composition beneath the nitride layer rapidly graded to a mixture of niobium and zirconium nitrides. The depth of the nitrided layer ranged from 1 to 2mm.

It is believed that this method of coating surfaces could be used for coating surfaces with other compounds by using other reactive gases. For example, a surface could be coated with a refractory-oxide-forming metal or metalloid (where refractory-oxide-forming "metal" refers to Zr, Hf, Y, Sc and the rare earths, U, Th, Ti, Al, Cr; and "metalloid" refers to Si) by flowing oxygen (air) through the furnace. Similarly, a surface could be coated with a refractory-carbide-forming metal or metalloid (where refractory-carbide-forming "metal" refers to Ti, Zr, Hf, Nb, Ta, V, Cr, Mo, and W; and "metalloid" refers to Si and B) by flowing a carbon containing atmosphere such as methane, acetylene, butane, or mixtures thereof with argon, helium or hydrogen through the furnace. Also, surfaces could be coated with a refractory-carbo-nitride-forming metal or metalloid (where refractory-"carbo"-nitride-forming "metal" refers to Ti, Zr, Hf, Nb, and Ta; and "metalloid" refers to Si and B) by flowing a gas mixture of carbon containing gas such as methane, acetylene, butane or mixtures thereof with argon, helium, hydrogen or ammonia and nitrogen through the furnace. In a similar manner to these examples of forming nitrides, oxides and carbides, any mixed phase (such as the "carbo" nitrides illustrated) can be produced: oxycarbides and oxynitrides (i.e., Si—O—N) can be produced and used as mixed-metal phases (i.e., Si—Al—O—N). This coating technique could be very useful for coating items such as crucibles, drill bits and cutting tools with special coatings which have desired properties.

Refractory metal composites of refractory metals, silicon and aluminum are rapidly and efficiently converted to the nitride and densified in one operation. Also, poor microwave couplers, such as silicon nitride, can be relatively sintered from the microwave-coupling elemental silicon and formed into dense composites.

It is believed that the subject development is not limited to the preparation and densification of refractory nitrides. Other intermetallic materials such as the borides, carbides and silicides could be easily and efficiently prepared and densified with the subject method by simply selecting the proper materials and conditions.

In the subject invention, the production of silicon nitride in a gaseous reaction with the required heat provided by a flux of microwave radiation is believed to be a significant contribution to the state of the art. In other applications, materials such as intermetallics, composites and coatings can be produced by the subject method. The combination of materials in a composite can be varied by including reactive and nonreactive components in a composite. A hard ceramic coating of a material can be formed on drill bits, cutting tools, and crucibles; and surfaces of articles can be coated with intermetallic mixtures such as the carbo-nitrides.

Shown in Tables I, II, and III are the conditions of processing and the data obtained for numerous examples of compacts of elemental silicon powder (alone or with the typical additions of appropriate amounts of yttrium oxide [or yttrium nitrate] to yield 6 wt. % $Y_2O_3$ and aluminum oxide [or aluminum nitrate] to yield 1.5 wt. % $Al_2O_3$) being microwave-treated in nitrogen atmosphere to yield silicon nitride. For the microwave-reaction of silicon given in Tables I, II, and III, either a 1.6 kW fixed power or a 0 to 6 kW variable power, standard frequency (2.45 GHz) microwave applicator was used. With specimens up to several inches thickness and over four inches diameter, experiments showed that the nitridation was uniform; the nitride was distributed evenly throughout the compacts. Iron oxide (which is typically added as a nitriding catalyst in conventional nitriding operations) was tested in the standard 3 to 5 wt. % level; the nitriding was about the same with or without this iron oxide addition. This is very important, since the iron oxide addition lowers the melting point of the grain boundary mixed oxide phase, thus lowering the high-temperature utility of the resultant silicon nitride. Thus, microwaved silicon nitride has a decided advantage over conventional reaction-bonded silicon nitride since the microwaved material does not require the detrimental iron oxide addition.

Also, it has been shown quantitatively that microwave heating enhances the nitridation of silicon to produce reaction-bonded silicon nitride (or "RBSN"). With microwave nitridation, only about 12 hours is required at 1350° C. to get approximately 95% conversion of the silicon metal to silicon nitride; whereas, conventional nitridation would require around 160 hours to accomplish the same degree of conversion to silicon nitride. In other words, the microwave nitriding takes less than one-tenth the time of conventional nitriding.

RBSN is important since the dimension of the part essentially stays the same before and after nitriding, an unusual feature of the reactive nitriding of silicon—to yield a dimensionally constant part. The dimensions of the un-nitrided silicon compact are essentially the same as the dimensions of the nitrided part; thus, by this process near-net-shape parts of silicon nitride can be produced.

The fact that microwave formation of silicon is so efficient may result from the enhanced reaction of the nitrogen at the grain-to-grain surfaces. Microwave energy is typically absorbed preferentially in the grain boundaries; micro-arcing may occur in the grain boundary regions. In any case, the nitriding of silicon is greatly enhanced. Silicon nitride (this is, completely nitrided silicon) is not a good microwave absorber. Thus, it is remarkable that silicon metal heats up readily and also readily converts to silicon nitride when a nitrogen atmosphere is utilized.

The subject invention offers investigators of intermetallics a rapid and efficient method for preparation and densification of these materials and compositions of them.

TABLE I

Data on Microwave - Reacted Silicon Materials in Nitrogen Atmosphere

| | Starting Composition (wt. %) | | | | | | | Ending Composition (wt. %) based on $N_2$ weight gain | | | | | | |
|---|---|---|---|---|---|---|---|---|---|---|---|---|---|---|
| Sample # | Silicon | Yttria | Alumina | Iron Oxide | Carbon | Iron | Silicon Nitride | Silicon Nitride | Silicon | Yttria | Alumina | Iron Oxide | Iron | Silicon Carbide |
| 1 | 95.2 | | | 2.9 | 1.9 | | | 73.2 | 20.3 | | | 2.0 | | 4.5 |
| 2 | 88.1 | 9.5 | 2.4 | | | | | 79.8 | 12.0 | 6.5 | 1.6 | | | |
| 3 | 100.0 | | | | | | | 76.9 | 23.1 | | | | | |
| 4 | 95.2 | | | 2.9 | 1.9 | | | 23.5 | 68.1 | | | 2.6 | | 5.7 |
| 5 | 90.6 | 8.0 | | | | 1.4 | | 37.6 | 54.4 | 6.8 | | | 1.2 | |
| 6 | 88.1 | 9.5 | 2.4 | | | | | 74.2 | 17.5 | 6.7 | 1.7 | | | |
| 7 | 88.1 | 9.5 | 2.4 | | | | | 71.0 | 20.4 | 6.8 | 1.7 | | | |
| 8 | 88.1 | 9.5 | 2.4 | | | | | 28.2 | 61.2 | 8.4 | 2.1 | | | |
| 9 | 88.1 | 9.5 | 2.4 | | | | | 29.4 | 60.1 | 8.4 | 2.1 | | | |
| 10 | 88.1 | 9.5 | 2.4 | | | | | 65.9 | 25.3 | 7.0 | 1.7 | | | |
| 11 | 44.05 | 4.75 | 1.2 | | | | 50.0 | 89.1 | 6.2 | 3.8 | 1.0 | | | |
| 12 | 95.2 | | | 2.9 | 1.9 | | | 71.7 | 21.7 | | | 2.1 | | 4.5 |
| 13 | 95.2 | | | 2.9 | 1.9 | | | 67.5 | 25.8 | | | 2.1 | | 4.6 |

TABLE II

Microwaving Conditions, Using 6 Kw, 2.45 GHz Processing Unit

| Sample # | Specimen Dimensions Inches (cm) D = diameter h = height | Initial Pellet Pressure Conditions | Weights + Initial/Final | | Soak Temperature $T_1$ (°C.) | Soak Temperature $T_2$ (°C.) | Heat-up Time (min) |
|---|---|---|---|---|---|---|---|
| 1 | D = 7.0 (17.7) h = 2.0 (5.0) | Isostatic, 10,000 psi | 1998.3 | 2823.7 | 1200–1400 | | ~30 |
| 2 | D = 1.0 (2.5) h = 0.67 (1.7) | Unidirectional 4,000 psi | 13.24 | 19.44 | 1260–1400 | 1500–1530 | 5 |
| 3 | D = 1.0 (2.5) h = 0.25 (0.64) | Unidirectional 4000 psi | 3.57 | 5.15 | 1260–1400 | 1500–1530 | 5 |
| 4 | D = 1.4 (3.6) h = 2.0 (5.0) | Isostatic, 10,000 psi | 90.68 | 100.14 | 1235–1370 | 1700 | 20 |
| 5 | D = 1.0 (2.5) h = 0.63 (1.6) | Unidirectional 4,000 psi | 12.74 | 14.99 | 1235–1370 | 1700 | 20 |
| 6 | D = 1.0 (2.5) h = 0.74 (1.9) | Unidirectional 4,000 psi | 15.00 | 21.30 | 1380–1400 | | 17 |
| 7 | D = 1.0 (2.5) h = 0.71 (1.8) | Unidirectional 10,000 psi | 17.65 | 24.64 | 1300–1400 | | 27 |
| 8 | D = 1.0 (2.5) h = 0.54 (1.4) | Unidirectional 10,000 psi | 13.44 | 15.15 | 1435–1470 | 1550–1800 | 15 |
| 9 | D = 1.0 (2.5) h = 0.55 (1.7) | Unidirectional 5,000 psi | 13.69 | 15.51 | 1435–1470 | 1550–1800 | 15 |
| 10 | D = 1.0 (2.5) h = 0.68 (1.7) | Unidirectional 4,000 psi | 13.92 | 18.89 | 1250–1350 | | 150 |
| 11 | D = 1.0 (2.5) h = 0.54 (1.4) | Unidirectional 4,000 psi | 11.51 | 14.29 | 1275–1400 | | 26 |
| 12 | D = 1.0 (2.5) h = 0.54 (1.4) | Isostatic 10,000 psi | 11.40 | 15.97 | 1360–1400 | | 54 |
| 13 | D = 1.4 (3.6) h = 3.5 (8.9) | Isostatic 10,000 psi | 140.37 | 192.11 | 1300–1400 | 1450–1600 | 60 |

| Sample # | Holding Time at $T_1$ (min) | Holding Time at $T_2$ (min) | Power Input $T_1$ (Kw) | Power Input $T_2$ (Kw) | "Casket" Packing Media Insulation | Final Specimen Density | % of Theoretical Density |
|---|---|---|---|---|---|---|---|
| 1 | 1395 | | 3.5–6.0 | | Zirconia Bubbles and Fiber | 2.29 | 75 |

TABLE II-continued

| Microwaving Conditions, Using 6 Kw, 2.45 GHz Processing Unit | | | | | | | |
|---|---|---|---|---|---|---|---|
| 2 | 160 | 60 | 0.5–3.0 | 3.0–4.0 | Zirconia Bubbles | 2.26 | 70 |
| 3 | 160 | 60 | 0.5–3.0 | 3.0–4.0 | Zirconia Bubbles | 1.59 | 53 |
| 4 | 7 | 303 | 0.5 | 0.5–1.2 | Zirconia Fiber | 1.99 | 80 |
| 5 | 7 | 303 | 0.5 | 0.5–1.2 | Zirconia Fiber | 2.21 | 76 |
| 6 | 152 | | 0.6–1.0 | | Zirconia Bubble | 2.22 | 70 |
| 7 | 180 | | 0.5–1.4 | | Zirconia Bubble | 2.68 | 85 |
| 8 | 67 | 85 | 0.4–0.7 | 0.4–0.5 | Fused Yttria Grit | 2.16 | 76 |
| 9 | 67 | 85 | 0.4–0.7 | 0.4–0.5 | Fused Yttria Grit | 1.81 | 64 |
| 10 | 150 | | 0.5–0.7 | | Zirconia Bubble | 2.17 | 70 |
| 11 | 84 | | 2.5–4.0 | | Zirconia Bubble | 2.04 | 63 |
| 12 | 85 | | 0.9–1.0 | | Zirconia Bubble | 2.31 | 76 |
| 13 | 24 | 249 | 0.4–2.2 | 1.8–5.0 | Zirconia Bubble | 2.16 | 72 |

TABLE III

| Sample No. | Percentage Based On: Initial wt. Final wt. if all reacted [%] | Reaction Based On: $N_2$ Pickup Total $N_2$ Pickup if all reacted [%] | Comments |
|---|---|---|---|
| 1 | 88 | 68 | Utilizes Iron Oxides as a possible nitriding promoter. |
| 2 | 93 | 80 | |
| 3 | 87 | 67 | |
| 4 | 69 | 17 | Utilizes Iron Oxides as a possible nitriding promoter. |
| 5 | 73 | 29 | Utilizes Iron Metal as a possible nitriding promoter. |
| 6 | 90 | 72 | |
| 7 | 88 | 68 | |
| 8 | 71 | 22 | |
| 9 | 71 | 23 | |
| 10 | 86 | 61 | |
| 11 | 93 | 73 | 50/50 Blend by weight of Pre-Reacted Silicon Nitride Powder and a $Si/Y_2O_3/Al_2O_3$ mix of composition 88.1/9.5/2.4% |
| 12 | 87 | 66 | Utilizes Iron Oxide as a possible nitriding promoter. |
| 13 | 85 | 61 | Utilizes Iron Oxide as a possible nitriding promoter. This sintered log was shown by microprobe to have a completely uniform distribution of nitrogen throughout. |

The new and improved method of the present invention for fabricating of refractory-nitride forming metal or metalloid dense articles, composites and coatings can specifically be used for nitriding composites of silicon in which the silicon contains reinforcement materials such as whiskers, platelets, fibers and/or particulates.

Reaction Bonded Silicon Nitride (RBSN) Composites are well known and have been made by conventional methods for many years. However, during the nitriding process the stability of the reinforcement materials suffer and degradation problems occur. These problems are caused by the length of time the composites are exposed to the nitriding process, typically equal to or greater than 40 hours, the high temperatures ( approximately 1400° C.) and the aggressive gaseous environments employed.

However, the microwave accelerated nitridation of a composite article of refractory-nitride-forming metal or metalloid containing reinforcing material of the present invention is typically done at temperatures equal to or less than 1359° C. in a nitrogen containing atmosphere and in a time period of less than 24 hours thus overcoming the problems mentioned above and producing a new and useful composite article.

EXPERIMENTAL PROCEDURE

A gel of silicon powder containing a reinforcement material was prepared by preparing a slurry containing 48 vol % of a silicon powder in a solution of the gelcasting monomer. The silicon powder was a high-purity silicon powder (Fe, 0.038%; Al, 0.080%; Ca 0.015%) obtained from Elkem Inc., Buffalo, N.Y., with a mean particle size of 4.2 μm. The gelcasting monomer was an acrylamide monomer [$CH_2{=}CHCONH_2$]. The other gel casting chemicals comprised a crosslinking agent, N,N[1]-methylene bisacrylaminide [$(CH_2{=}CHCONH)_2CH_2$], and a free radical initiator, ammonium persulfate [$(NH_4)_2S_2O_8$]. The silicon powder "as-received" had a relatively high specific surface area (4.96 $m^2/g$), measured using Quantasorb Sorption System, Quantachrome Inc., Syosset, N.Y., and behaved as a catalyst and prematurely polymerized the acrylamide monomer with the crosslinking agent into a gel when prepared into a slurry. Therefore, the silicon powder was heat treated to reduce the surface activity of the silicon powder by heating the silicon powder in nitrogen in a tube furnace at 800° C. for 4 hours. No measurable weight gain (<0.02 wt. %, the limit of detection) was observed in the powder. Slurries made with the heat-treated silicon powder did not polymerize prematurely.

The resulting slurry was poured into a mold which had been chilled in ice water. Initial attempts to deair the slurry by stirring it under vacuum at room temperature resulted in premature gelation. The free radical initiator was then mixed into the slurry. Before pouring the slurry into the mold, the SiC fibers as the reinforcement material were cut to length and treated with the slurry to improve wetting of the SiC fibers by brushing the slurry on the fibers. Then the treated fibers were manually arranged in the mold and the balance of the slurry was added to the mold. The reinforcement material used was unidirectional SiC fibers, Nicalon Fiber, a trademark of Nippon Carbon Company, Tokyo, Japan. An alternate reinforcement material can be used such as silicon carbide whiskers, silicon nitride whiskers, silicon carbide platelets, carbon fibers, alumina fibers, silicon carbide particulates as well as reinforcement materials such as whiskers, platelets, fibers and/or particulates of chemically compatible materials. A heavy metal block was placed on top of the slurry to compress the fibers, thus squeezing excess slurry to the side of the mold.

The mold was a brass rectangular mold. The nominal cross section of the mold was 38×38 mm with the thickness of the gelcast body dependent on the amount of slurry used in the mold. The length of the mold can be varied from 50 mm to 225 mm.

The mold was heated to 50° C. to gel the contents of the mold into a composite green body. The composite green body was dried in a controlled humidity chamber at room temperature. The polymer was removed by heating the dried composite green body in air to 600° C. The composite green body was reaction-bonded with a nitrogen containing atmosphere (~0.1 MPa) in a 2.45 GHz microwave furnace at a temperature cycle lasting for approximately 20 hours. The heating rate was 5° C./min to 800° C., 2° C./min to 1100° C., 0.5° C./min to 1250° C. and held for 8 hours, or to 1350° C. and held for 4 hours.

The gelcast blocks, after drying, showed a 3% average linear shrinkage, and the blocks microwaved were 75×35×15 mm. Also there was more shrinkage in the middle than in the edges due to the squeezing of the slurry to the sides of the mold during forming and also due to some uneven fiber packing. Because the slurry was not deaired, voids from trapped air bubbles were observed on the surface of the dried green bodies. This probably would reduce the strength of the composites.

For the sample of Si-Nicalon fiber composite which was processed at 1350° C. for 4 hours, the Nicalon initial wt. % was 28.8, the nitridation wt gain was 57.2% and the Si reaction was 86.4%. For the sample of Si-Nicalon fiber composite which was processed at 1250° C. for 8 hours, the Nicalon initial wt. % was 28.8, the nitridation wt gain was 57.2% and the Si reacted was 89.1%. The Si reacted was based on the theoretical weight gain of 66.5% for pure silicon. The $SiO_2$ content and any weight loss from Silicon volatization were not accounted for.

Because the composites were thick (15 mm), the nitridation was conducted at relatively long times at the respective temperatures. The nitridation times would be much longer in a conventional furnace. In both cases, however, there was no obvious fiber degradation during the nitridation at either temperature 1250° C. for 8 hours or 1350° for 4 hours. There was only limited fiber pullout for the composites formed at 1350° C. and 4 hours; whereas, significant fiber pullout was observed for the samples nitrided at 1250° C. for 8 hours.

Flexure specimens were prepared from the sintered composites using a diamond saw. The nominal cross section of the specimens was 3×4 mm with varying lengths >20 mm. The strengths were measured in 4-point bending with a support span of 19 mm and inner span of 6 mm. The cross-head speed was 0.005 mm/min. Fracture surfaces were examined using a scanning electron microscope (SEM).

The load-deflection data of the composite sintered at 1250° C. showed graceful failure beginning at a stress of approximately 85 MPa at crosshead displacement of approximately 0.113 mm and complete failure at a stress of approximately 44 MPa at crosshead displacement of approximately 0.156 mm indicating matrix cracking, some load transfer, and crack bridging, all of which demonstrate fiber integrity. The load-deflection data of the composite formed at 1350° C. showed brittle failure at a stress of approximately 70-MPa MPa at crosshead displacement of approximately 0.112 mm due possibly to some fiber degradation and strong matrix-to-fiber bonding. The strengths measured for these composites, 70 to 85 MPa, were similar to Nicalon-RBSN composites made by other researchers. However, the present composites were not optimized and, in fact, contained large (>500 μm) pores due to inadequate deairing of the silicon slip prior to composite fabrication. Hence, the strengths were low.

The above work show that relatively thick RBSN composites can be formed by gelcasting and reaction-bonding in the microwave. This implies that advantage can be taken of the strong points of gelcasting particularly for complex shape formation.

The fiber integrity in these thick composites reaction-bonded in the microwave seems to be more sensitive to the processing temperature than to the duration of the nitridation. Thus, nitridation at 1250° C. for 8 hours produces stronger and tougher composites than those formed at 1350° C. for 4 hours. For thick RBSN composites, microwave processing, in contrast to conventional processing, may be used to reduce fiber degradation because lower nitridation temperatures, shorter nitridation times, and the use of high-purity silicon powders and pure nitrigen gas are possible.

While there has been shown and described what is at present considered the preferred embodiment of the invention, it will be obvious to those skilled in the art that various changes and modifications may be made therein without departing from the scope of the invention as defined by the appended claims.

What is claimed is:

1. A method of nitriding a composite article of refractory-nitride-forming metal or metalloid and a reinforcing material comprising the following steps:

Step 1) providing a composite article of metal or metalloid containing a reinforcing material being intimately enwrapped with a ceramic aggregate of granular material within a microwave oven;

Step 2) introducing a nitrogen containing atmosphere within said microwave oven;

Step 3) heating said composite article in a nitrogen containing atmosphere within said microwave oven to a temperature sufficient to react with said metal or metalloid of said composite article with said nitrogen by applying a microwave energy within said microwave oven; and Step 4) maintaining said composite article at said temperature for a period of time sufficient to convert said metal or metalloid of said composite article to a composite article of refractory nitride.

2. A method in accordance with claim 1 wherein said metal of said composite article is selected from the group consisting of aluminum, titanium, tantalum, hafnium, zirconium, niobium and mixtures thereof; said metalloid of said composite article is selected from the group consisting of silicon, boron, and mixtures thereof; and said reinforcing material is selected from the group consisting of whiskers, platelets, fibers, particulates, and mixtures thereof.

3. A method in accordance with claim 1 wherein said microwave energy is generated by a 2.45 GHz microwave oven.

4. A method in accordance with claim 1 wherein said composite article being intimately enwrapped in a ceramic aggregate of granular material is contained in a refractory ceramic container, said ceramic aggregate of granular material having an average particle size ranging from −4 to +100 mesh.

5. A method in accordance with claim 1 wherein said temperature in Step 3 is greater than 1,000 degrees centigrade.

6. A method in accordance with claim 1 wherein said article of refractory nitride has a density up to and including 85% of theoretical density.

7. A method in accordance with claim 1 wherein said nitrogen containing atmosphere comprises gases selected from the group consisting of nitrogen, ammonia and mixtures thereof and gases selected from the group consisting of hydrogen, inert gases and mixtures thereof.

8. A method in accordance with claim 1 wherein said reinforcing material comprises silicon carbide whiskers.

9. A method in accordance with claim 1 wherein said composite article comprises silicon and a reinforcing material.

10. A method in accordance with claim 9 wherein said refractory nitride is silicon nitride.

11. A method in accordance with claim 1 wherein said heating in Step 3 comprises heating at a heating rate of about 5° C./min to about 800° C., about 2° C./min to about 1100° C., about 0.5° C./min to about 1250° C. and said period of time in Step 4 is approximately 8 hours.

12. A method in accordance with claim 1 wherein said heating in Step 3 comprises heating at a heating rate of about 5° C./min to about 800° C., about 2° C./min to about 1100° C., about 0.5° C./min to about 1250° C. and said period of time in Step 4 is approximately 4 hours.

13. A method in accordance with claim 1 wherein said composite article of metal or metalloid containing a reinforcing material is prepared by a gelcasting procedure.

14. A method in accordance with claim 13 wherein said gel casting procedure comprises heat treating a silicon powder at about 800° C. in a nitrogen containing atmosphere for a period sufficient to reduce the surface activity of said silicon powder.

* * * * *